US008217576B2

(12) United States Patent
Ishikawa et al.

(10) Patent No.: US 8,217,576 B2
(45) Date of Patent: Jul. 10, 2012

(54) HIGH PRESSURE DISCHARGE LAMP

(75) Inventors: Hirohisa Ishikawa, Himeji (JP); Nobuhiro Nagamachi, Himeji (JP); Toyohiko Kumada, Himeji (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 277 days.

(21) Appl. No.: 12/700,246

(22) Filed: Feb. 4, 2010

(65) Prior Publication Data

US 2010/0201265 A1 Aug. 12, 2010

(30) Foreign Application Priority Data

Feb. 6, 2009 (JP) ..... 2009-025697

(51) Int. Cl.
*H01J 17/18* (2006.01)

(52) U.S. Cl. ..... 313/623; 313/326

(58) Field of Classification Search ..... 313/631, 313/621, 570, 574, 623, 326
See application file for complete search history.

(56) References Cited

U.S. PATENT DOCUMENTS

| | | | |
|---|---|---|---|
| 2008/0185950 | A1 | 8/2008 | Claus et al. |
| 2008/0246401 | A1 | 10/2008 | Bunk et al. |
| 2008/0315771 | A1 | 12/2008 | Tsukamoto et al. |

FOREIGN PATENT DOCUMENTS

| | | | |
|---|---|---|---|
| JP | 5-198284 | A | 8/1993 |
| JP | 2006-134710 | A | 5/2006 |
| JP | 3142271 | U | 5/2008 |
| JP | 2008-529252 | A | 7/2008 |
| WO | 2007/122535 | A2 | 11/2007 |

OTHER PUBLICATIONS

English Translation of JP 2006-134710, published May 25, 2006.*
Japanese Office Action Dated Jun. 21, 2011, Verification of Translation and English Translation of Japanese Office Action.

* cited by examiner

*Primary Examiner* — Nimeshkumar Patel
*Assistant Examiner* — Mary Ellen Bowman
(74) *Attorney, Agent, or Firm* — Roberts Mlotkowski Safran & Cole, P.C.; David S. Safran

(57) ABSTRACT

In a high pressure discharge lamp having electrode rods with grooves formed in a part thereof and embedded and sealed in sealing parts of a discharge vessel, breakage of the sealing parts because of the grooves is prevented without impairing the mechanical strength of the electrode rods, in which the grooves are formed, by the high pressure discharge lamp comprising: a discharge vessel having a light emitting part and sealing parts connected to both ends of said light emitting part; and electrodes comprising electrode rods and electrode tip end parts arranged oppositely to each other in the light emitting part, said electrode rods being embedded in a respective one of said sealing parts, and axially directed grooves being formed in at least part of the surface of said electrode rods, wherein a diameter measured at groove bottom parts of the grooves of said electrode rods is larger than a diameter of the electrode rods in a part where no grooves are formed.

3 Claims, 2 Drawing Sheets

HIGH PRESSURE DISCHARGE LAMP

BACKGROUND OF THE INVENTION

1. Field of the Invention

This invention relates to high pressure discharge lamps and relates in particular to short arc type high pressure discharge lamps suited for use in liquid crystal projectors etc.

2. Description of Related Art

In this kind of high pressure discharge lamps, electrode rods of a pair of electrodes arranged oppositely to each other in the light emitting part of the discharge vessel are buried and sealed in sealing parts at both ends of the light emitting part. For said sealing parts there is the problem of a damage or breakage of the quartz glass caused by the difference in the coefficients of thermal expansion of the electrode rod made from normal tungsten and the sealing part made from quartz glass, and this problem becomes even more severe with the above mentioned high pressure discharge lamps for use in projectors, as a large amount of mercury of at least 0.15 $mg/mm^3$ is contained in the light emitting part and the mercury vapor pressure at the time of switching-on becomes at least 100 atm.

To solve this problem, various measures have been taken to buffer the difference in the thermal expansions between the electrode rod and the sealing part, and as one of these it was suggested in JP-A-2008-529252 and corresponding US 2008/0185950 A1 to provide axially directed grooves in the electrode rods. This known technique is shown in FIG. 5. In this figure, electrodes 1 made from tungsten comprise tip end parts 2 arranged oppositely to each other in a light emitting part 5 and electrode rods 3 at which said tip end parts 2 are mounted. The electrode rods 3 are embedded and sealed in sealing parts 6 connected with the light emitting part 5 of a discharge vessel 4 made from quartz glass. At said electrode rods 3, axially directed grooves 31 are formed, and the part in which these grooves 31 are formed is embedded and sealed in the sealing part 6. By doing so, the surface roughness in the circumferential direction of the electrode rod 3 becomes higher than the surface roughness in the longitudinal direction, and the flaw of a breakage of the sealing part caused by a difference in the coefficients of thermal expansion between the material of the electrode rod 3 (tungsten) and the material of the sealing part 6 (quartz glass) can be eliminated.

But this known technique results in the inconvenience that the mechanical strength decreases and the phenomenon of bending or breaking of the electrode rod 3 occurs since the diameter of the groove bottom circle defined by the bottom parts of the grooves 31, which determines the mechanical strength of the electrode rod 3, becomes smaller than the diameter of the electrode rod 3 because of the formation of the grooves 31 in the electrode rod 3.

SUMMARY OF THE INVENTION

Based on the problems described above, a primary object of the present invention is to provide a high pressure discharge lamp in which breakage caused by the different coefficient of thermal expansion of the sealing parts made from quartz glass can be prevented while suppressing the bending or breakage of the electrode rods.

To solve the above mentioned problems this invention provides a high pressure discharge lamp having a discharge vessel having a light emitting part and sealing parts connected to both ends of said light emitting part; and electrodes comprising electrode rods and electrode tip end parts arranged oppositely to each other in the light emitting part, said electrode rods being embedded in a respective one of said sealing parts, and axially directed grooves being formed in at least part of the surface of said electrode rods, wherein a diameter measured at groove bottom parts of the grooves of said electrode rods is larger than a diameter of the electrode rods in a part where no grooves are formed.

In an embodiment of the invention, said axially directed grooves are formed by boring out circular bottomed holes in the radial direction of the electrode rod adjacent to each other in the axial direction.

By means of this invention, the mechanical strength of the part in which grooves are formed, does not decrease as compared to the strength of the parts in which no grooves are formed, and no bending or breakage of the electrode rod because of the formation of the grooves occurs, because the diameter of the groove bottom circle of the axially directed grooves formed in the electrode rods is larger than the diameter of the parts in which no grooves are formed. As the axially directed grooves are preferably formed by providing circular bottomed holes in the radial direction, a shortening of the processing time is expected as compared to the case in which grooves with a constant width are formed in the axial direction.

BRIEF DESCRIPTION OF THE DRAWINGS

FIG. 2(*b*) is a cross-sectional view taken along the arrows in FIG. 2(*a*).

FIG. 2(*c*) is an enlarged partial view of the grooves of FIG. 2(*b*).

FIG. 4(*b*) is an enlarged partial view of the grooves of FIG. 4(*c*).

FIG. 4(*c*) is a cross-sectional of the electrode rod of FIG. 4(*a*), corresponding to the view of FIG. 2(*b*).

In FIG. 1, a high pressure discharge lamp 10 has a discharge vessel 4 made from quartz glass and electrodes 1. The electrodes 1 comprise an electrode rod 3 and a tip end part 2 mounted at the tip end of the electrode rod 3, while the discharge vessel 4 comprises a light emitting part 5 and sealing parts 6 connected therewith. Said electrode tip end parts 2 are arranged oppositely to each other in the light emitting part 5. The electrode rods 3 are embedded and sealed in the sealing parts 6.

The electrode tip end parts 2 are shown integrally with the electrode rods 3 but are not limited to this configuration and may of course also well be separated therefrom.

Figure 1:
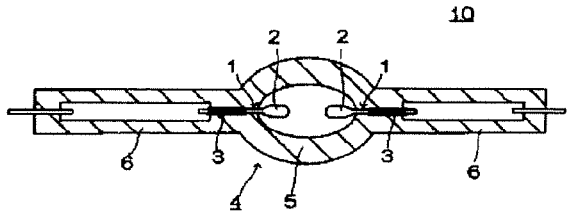
FIG. 1 schematically shows a high pressure discharge lamp according to the present invention.
Figure 2A:
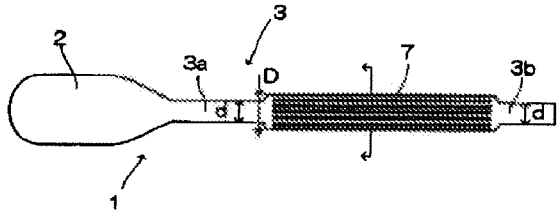
FIG. 2(*a*) is an enlarged view of one of the electrodes of FIG. 1.
Figure 2B:
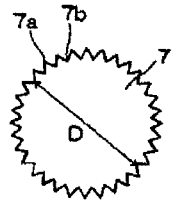
Figure 2C:
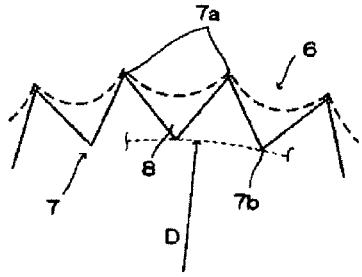

As shown in FIG. 2(*a*), axially directed grooves 7 are formed peripherally at a part of said electrode rod 3. As shown in FIG. 2(*b*) and FIG. 2(*c*), the grooves 7 are continuous grooves consisting of zigzag-shaped peaks 7*a* and valleys 7*b* and are formed, in this example, along the whole periphery in the circumferential direction. The diameter of the part in which the grooves 7 are to be formed is larger than the diameter of the parts without grooves, and also the diameter D of the groove bottom circle connecting the valleys 7*b* of the formed grooves 7 is formed larger than the diameter d of the parts 3*a*, 3*b* of the electrode rod 3, in which no grooves are formed.

As shown in FIG. 2(*c*), the sealing part 6 intrudes into a part of the grooves 7 at the time of the thermal processing, but does not embed the whole grooves, and a space 8 is formed.

The forming of said grooves 7 can be effected by utilizing various processing methods such as drawing processing, cutting processing, etching, laser processing etc.

Figure 3A:
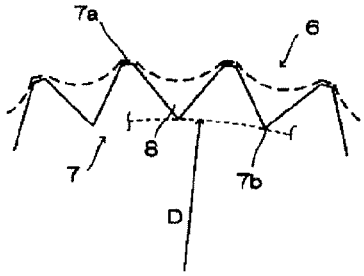
FIGS. 3(*a*) and 3(*b*) are enlarged views schematically showing embodiments of the grooves.
Figure 3B:
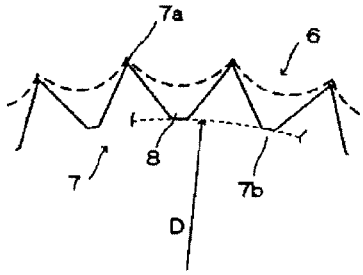

It is not necessary for the cross-sectional shape of the grooves 7 to have sharp peaks 7*a* and valleys 7*b*. The shape may also be such that the peaks 7*a* have a flattened part at the tip end as shown in FIG. 3(*a*) or that a flattened part is formed in the valleys 7*b* as shown in FIG. 3(*b*). And, although this is not shown, also a shape is possible in which a flattened part is provided both at the peaks and the valleys.

It goes without saying that also in these examples the diameter D of the groove bottom circle connecting the valleys 7*b* of the grooves 7 is larger than the diameter of the parts 3*a*, 3*b* in which no grooves are formed.

Figure 4A:
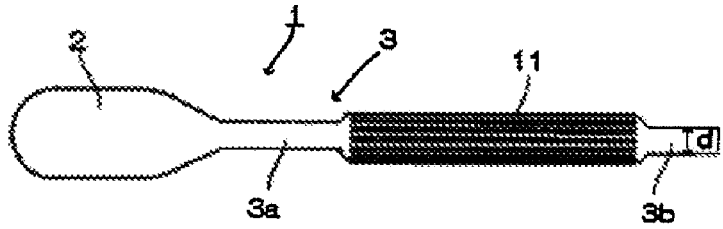
FIG. 4(*a*) is an enlarged view of one of the electrodes of FIG. 1 showing a second embodiment of the invention.
Figure 4B:
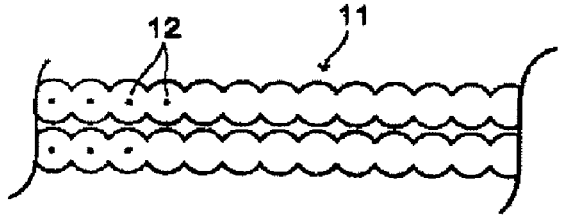
Figure 4C:
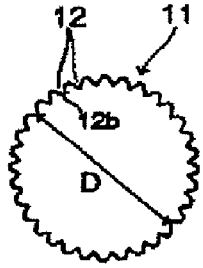
Figure 5:
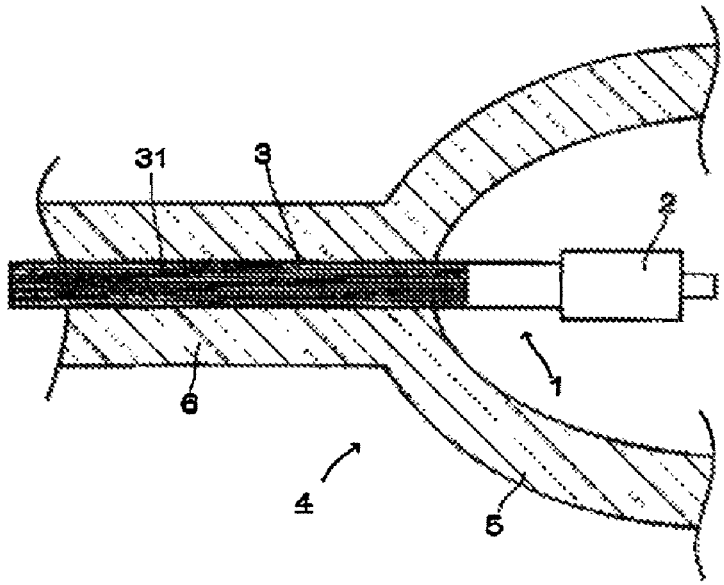
Fig. 5 (Prior Art)
FIG. 5 shows an example of a prior art lamp.

In the above mentioned example it is shown that the cross-sectional shape of the grooves 7 is continuous in the axial direction, but as shown in FIG. 4, it must not be a continuous shape. In this figure, grooves 11 are formed in the electrode rod 3 by boring out radially directed bottomed holes 12 adjacent to each other in the axial direction. The adjoining holes 12 are mutually continuous in one part so that, as a whole, axially directed grooves 11 are formed. Also in this case the diameter D of the groove bottom circle connecting the valleys of the grooves 11, that is, the bottom parts 12*b* of the holes 12, is larger than the diameter d of the parts 3*a*, 3*b* without formation of grooves. A laser processing is ideal to form the grooves in this example, and in comparison to the continuous grooves in FIG. 2 and FIG. 3 only a short time is required for the processing of the grooves.

EXAMPLE

In a high pressure discharge lamp 10 for use in a projector, mercury, a rare gas and a halogen gas are enclosed in the light emitting part 5. Regarding the mercury amount, at least 0.15 $mg/mm^3$ are enclosed to obtain the necessary wavelength of visible light, for example 360 to 780 nm, and at the time of operation, a mercury vapor pressure of at least 150 atm arises. For the rare gas to improve the starting characteristics, argon gas is enclosed in an amount of approximately 13 kPa. Then, to improve the durability of the lamp by means of the halogen cycle, a halogen gas such as iodine, bromine or chlorine is enclosed in a range of $1\times10^{-6}$ to $1\times10^{-2}$ $\mu mol/mm^3$.

To show a numerical example for a high pressure discharge lamp 10, for example the light emitting part 5 has a maximum outer diameter of 11.3 mm, an interior volume of 115 $mm^3$ and an electrode spacing of 1.1 mm. The diameter of the electrode rods 3 of the electrodes 1 is 0.3 to 1.0 mm, and the tube wall load is 0.8 to 3.0 $W/mm^2$.

In the example shown in FIG. 2, the tip end part 3*a* and the rear end part 3*b* of the electrode rod 3 have a small diameter while the center part, that ist, the part in which the grooves 7 are formed, has a large diameter. The diameter d of the tip end part 3*a* and the rear end part 3*b* is 0.38 to 0.58 mm while the diameter D of the groove bottom circle of the grooves 7 is a diameter larger than that with a value of 0.40 to 0.60 mm.

The depth of the grooves is 10 μm, and the pitch in the circumferential direction is 25 μm. In the example shown in FIG. 4, the bottomed holes 12 forming the grooves 11 have a diameter of 0.01 to 0.05 mm and are bored out adjacent to each other such that a part is mutually continuous and, as a whole, axially directed grooves 11 are formed.

Since, as explained above, in the high pressure discharge lamp of this invention, wherein axially directed grooves are formed in the electrode rods, the diameter of the groove bottom circle is larger than the diameter of the parts in which no grooves are formed, a breakage of the sealed parts because of the grooves is prevented without impairing the mechanical strength of the electrode rods and without bending or breakage of these electrode rods.

What is claimed is:

1. A high pressure discharge lamp comprising:

a discharge vessel having a light emitting part and sealing parts connected to both ends of said light emitting part; and electrodes comprising electrode rods and electrode tip end parts arranged oppositely to each other in the light emitting part, said electrode rods being embedded in a respective one of said sealing parts, and axially directed grooves being formed in at least part of the surface of said electrode rods, wherein said electrode rods have an ungrooved rear end part where no grooves are formed, said ungrooved rear end part being located rearward in an axial direction relative to the part in which said grooves are formed, wherein a portion of the part of said electrode rods in which said grooves are formed is embedded in the respective sealing part along with said ungrooved rear end part, and wherein a diameter measured at groove bottom parts of the grooves of said electrode rods is larger than a diameter of the ungrooved rear end part where no grooves are formed.

2. A high pressure discharge lamp according to claim 1, wherein said axially directed grooves are formed by providing bottomed circular holes bored out in a radial direction of the electrode rod in an axial direction adjacent to each other.

3. A high pressure discharge lamp according to claim 1, wherein a portion of a tip end part of said electrodes located forward of said part in which said grooves are formed is ungrooved and wherein the diameter measured at the groove bottom parts of the grooves of said electrode rods is larger than a diameter of the ungrooved portion of the tip end part.

* * * * *